United States Patent [19]

Hall

[11] Patent Number: 4,907,997

[45] Date of Patent: Mar. 13, 1990

[54] SURVIVAL CRAFT

[76] Inventor: Joseph S. Hall, 281 Miami Drive, Keswick, Ontario, Canada, L4P 2Z5

[21] Appl. No.: 259,910

[22] Filed: Oct. 19, 1988

[30] Foreign Application Priority Data

Apr. 26, 1988 [CA] Canada ..... 565122

[51] Int. Cl.[4] ..... B63B 7/08

[52] U.S. Cl. ..... 114/345; 114/349; 114/361; 441/40

[58] Field of Search ..... 114/345–349, 114/354, 355, 357, 361, 267; 441/35, 38, 40

[56] References Cited

U.S. PATENT DOCUMENTS

| | | | |
|---|---|---|---|
| 2,854,014 | 7/1958 | Hasselquist | 114/349 |
| 2,873,459 | 2/1959 | Marz | 114/347 |
| 2,962,732 | 12/1960 | Marz | 114/347 |
| 3,768,467 | 10/1973 | Jennings | 441/40 |
| 3,840,919 | 10/1974 | Middleton | 135/96 |
| 4,000,585 | 1/1977 | Dewaru | 52/155 |
| 4,301,791 | 11/1981 | Franco | 441/104 |
| 4,607,655 | 8/1986 | Wagner | 52/DIG. 13 |
| 4,750,447 | 6/1988 | Spinosa | 441/40 |

*Primary Examiner*—Joseph F. Peters, Jr.
*Assistant Examiner*—Clifford T. Bartz

[57] ABSTRACT

A single person survival craft having a bottom panel, and two side panels, formed of a plurality of hollow tubular structures progressively reducing in number towards each end, a releasable closure extending along edges of each of the side panels by which they may be opened up and closed, and a liquid tight air permeable membrane in at least one of the side panels.

6 Claims, 3 Drawing Sheets

SURVIVAL CRAFT

The invention relates to a survival craft for use on the water.

BACKGROUND OF THE INVENTION

A person in distress in the water, who is either forced into the water from some larger craft, or for example from an airplane, even if they are equipped with a life preserver, may suffer injury or death from the cold within a short space of time.

Even if supported on some form of open raft, the cold will be such that the person is unlikely to survive for any length of time, except in warmer climates.

Rafts are available in which an inflatable platform is provided for supporting a person, or persons, in the water, and on which a form of cover or enclosure is provided. Such rafts are relatively expensive, and are also of considerable size even when packaged and stored. As such they are not suitable for carrying for example on a light plane, or a small fishing boat such as may be occupied by one or two persons.

In addition to the large size and expense involved in a typical survival raft, such craft did not always offer adequate insulation from the cold. Thus usually the enclosure or cover for such a raft would not be insulated, and the occupants would suffer from the effects of the cold after occupying it for any length of time.

A further factor in the design of a typical survival raft, is the problem of providing a sufficient degree of rigidity, to maintain its shape during use in the water.

All of these problems are compounded, when it is attempted to design a survival craft for a single person, and to provide such a craft which is small and light weight, such that it can form part of the equipment of, for example, an individual on a canoe trip, or a fisherman, or the pilot of a small plane.

A still further problem in relation to the use of rescue rafts results from the action of the wind. Since such craft are of light weight, and ride on the surface of the water, they are susceptible to the action of the wind to a greater degree than more conventional craft such as boats. As a result, the wind is liable to blow such a craft a considerable distance, and in many cases may easily turn the craft over.

This factor becomes particularly critical when it is desired to provide a small scale rescue craft for individual use.

BRIEF SUMMARY OF THE INVENTION

With a view to overcoming the various problems noted above, the invention comprises a single person survival craft having a bottom panel, and two side panels, the bottom panel comprising a plurality of hollow tubular structures, said bottom panel having two pointed ends, and a wide mid-section, and in the region of said mid-section, there being a predetermined plurality of said hollow tubular structures, and said number of tubular structures progressively reducing towards each of said pointed ends, said tubular structures being of arcuate shape and joined to one another in side by side abutting relationship, and each of said side panels having pointed ends and a wide mid-section, and there being a predetermined plurality of hollow tubular structures at said mid-section, and the numbers of said tubular structures decreasing progressively from said mid-section, towards each of said pointed ends, each said side panel being joined to said bottom panel along a first edge, and, there being releasable closure means extending along a said second edge of each said side panel, whereby said second edge may be opened up and closed together, and water tight air permeable mesh means in at least one of said side panels.

More particularly, the objective of the invention is to provide a craft having the foregoing advantages wherein in each of said bottom panels and said side panels there are at least two of said tubular structures extending from one said pointed end to the other, and there being further said tubular structures of progressively reduced length.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 1:
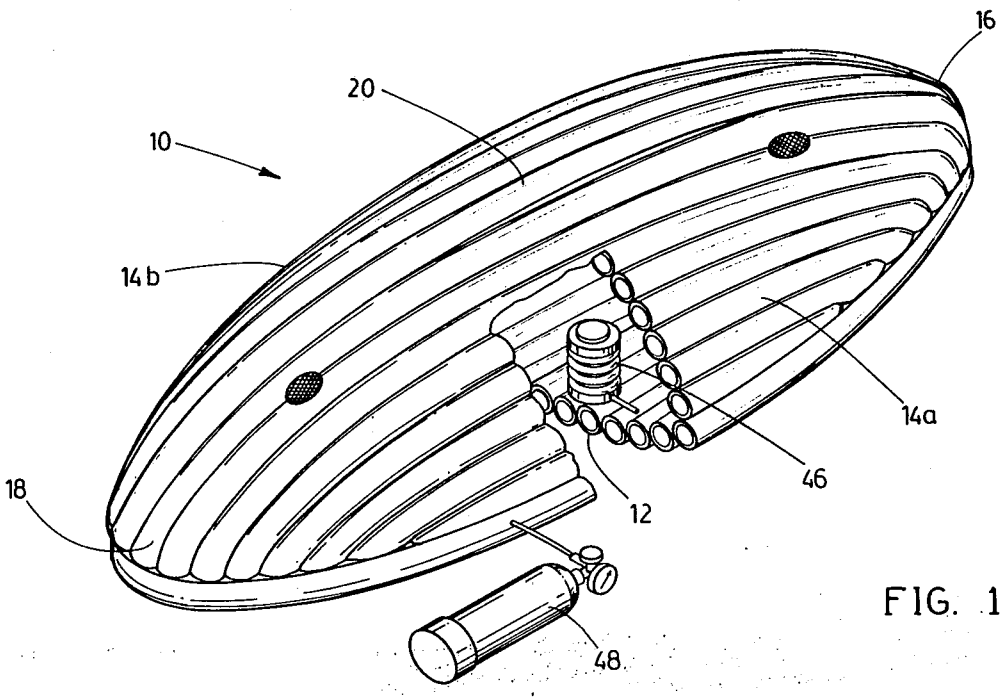
FIG. 1 is a perspective illustration showing a one-man survival craft in accordance with the invention.
Figure 2:
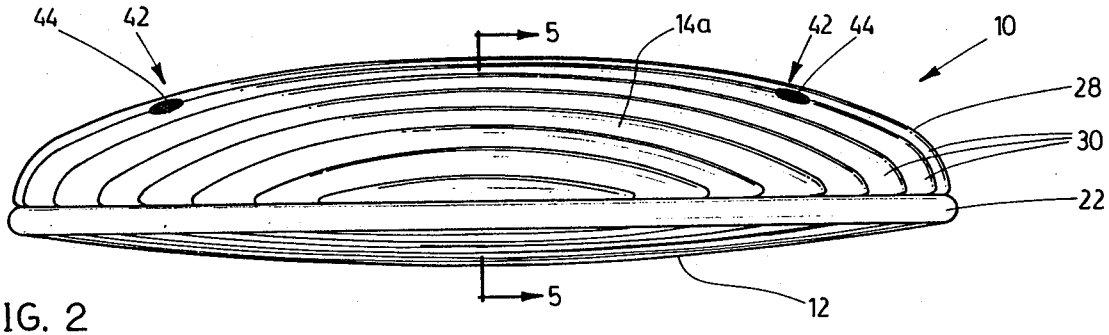
FIG. 2 is a side elevation of the craft of FIG. 1.
Figure 3:
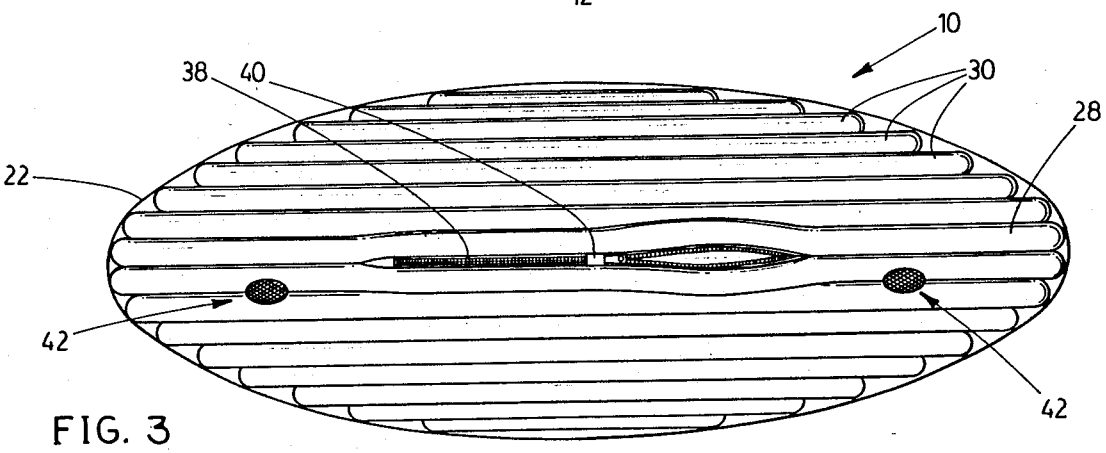
FIG. 3 is a top plan view of the craft of FIG. 1.
Figure 4:
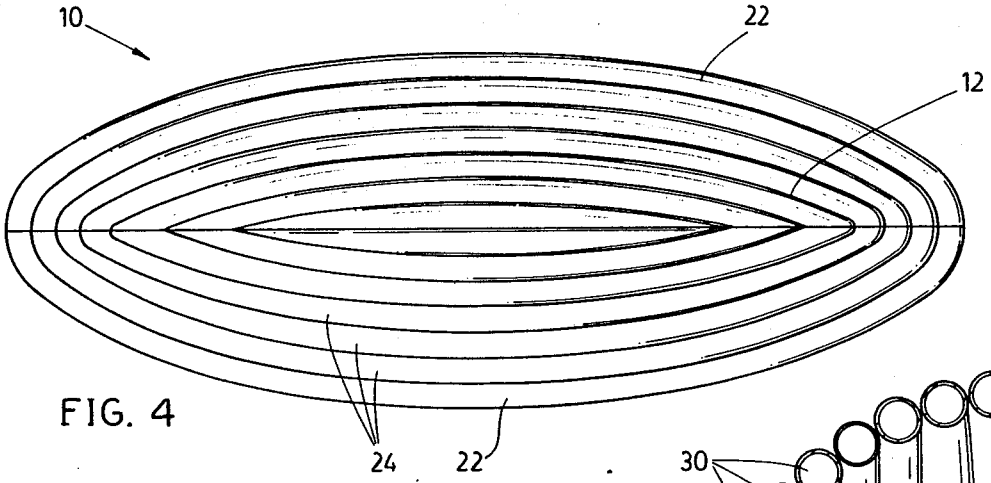
FIG. 4 is a bottom plan view of the craft of FIG. 1.
Figure 5:
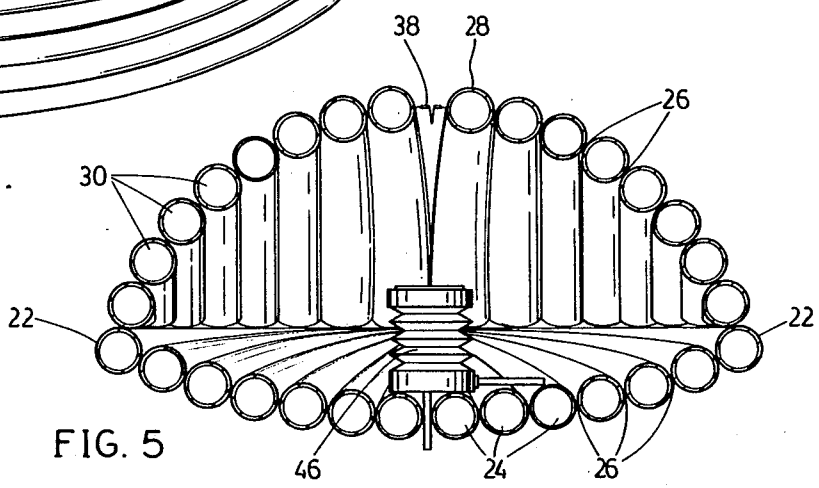
FIG. 5 is a section along line 5—5 of FIG. 2.

Referring first of all to FIG. 1 the invention will be seen to comprise an individual survival craft indicated generally as 10, which generally in turn comprises a bottom panel 12, and two side panels **14*a* and 14*b***, which together, form a generally three sided envelope, enclosing an interior chamber. Such a chamber will have a length somewhat in excess of the length of a human body, and define a width at the centre, somewhat in excess of a human body.

It will be observed that the craft 10 has pointed ends 16 and 18, and is at its widest at about its mid-section indicated generally as 20.

The sides slope upwardly towards one another so that in section the craft defines a generally curved or distended triangular shape.

It will be seen that the bottom panel 12 comprises a plurality of hollow tubular structures of flexible air and water tight material. In the bottom panel 12, there are two full length peripheral tubular structures 22—22 and a plurality of intermediate tubular structures 24, between the tubular structures 22.

The intermediate tubular structures 24, are of such lengths that they reduce progressively, as they are spaced away from the peripheral structures 22—22. Each of the intermediate tubular structures 24, has an end portion which is angled.

The tubular structures 22—22 in the bottom panel 12 are of curved arcuate shape in plan and define a peripheral edge which is progressively increasingly curved from the mid-section towards each of the pointed ends 20 so as to provide in plan a generally oval shape with pointed ends, in which the curvature is of progressively reducing radius from the mid-section towards each end.

The intermediate structures 24, are also of curved arcuate shape in plane, of progressively reducing "radius", so as to conform and nest against each other.

The term "radius" is used here in a general sense and without limiting the shape to a true geometrical curve.

All of the structures 22 and 24, are integrally joined along seams 26.

All of the chambers defined by the tubular structures are in air communication with one another through air passageways indicated in phantom as 36, for ease of inflation.

Each of the side panels 14*a* and 14*b* will be seen to be comprised of a plurality of tubular structures, arranged in a somewhat similar fashion to one half of the bottom panel 10.

Each of the side panels has a full length axial tubular structure 28, and a plurality of adjacent tubular structures 30.

Each of the adjacent tubular structures 30 is of a length less than the full length axial structure 28, and the length decreases progressively away from the full length structure 28. The ends of the adjacent tubular structures are angled. In this way, the peripheral edges of the side panels 14a, 14b define a generally smooth curve from end to end. The full length structures 28 define a continuous curve rising from each end towards the mid-point of the craft and define progressively reducing "radius" (as used above) from the mid-section of the craft, to each end.

Each of the side panels is widest at its mid-section, and tapers progressively towards each end.

The structures 28 and 30 in each side panel are joined along seams 32.

The side panels are joined integrally to the bottom panel at seams 34, around the periphery of the bottom panel and extend upwardly therefrom.

The upper edges of the two side panels are integrally joined as at 36, adjacent each end. Along a central portion of the upper edges, a continuous water and air tight fastening device 38 is provided, by means of which the edges of the two side two side panels may be opened up, and closed once more.

The fastening device has two manual tabs 40, one located on the inside of the craft and the other on the outside. In this way the fastening device can be operated both from the outside and the inside.

In order to permit breathing within the chamber, at least one, and in this particular embodiment two port holes 42 are provided in the side panels. Such port holes are provided with an air permeable mesh 44, of a type which is water tight, but which will permit the free passage of air.

In addition, it may be desirable to provide an optional baling pump 68, to remove any water which may enter the chamber.

The tubular structures in the two side panels are all interconnected with one another, for ease of inflation, and are also interconnected with the tubular structures in the bottom panel, by passageways 68, shown in phantom.

Typically a gas cylinder 48 will be provided, which may be manually operated, or which alternatively may be automatically operated by contact with the water in a manner well known in the art, in order to inflate the craft rapidly.

The operation of the craft is self-evident. In use it will float on the surface, and its low profile, and curved shape will offer only a small surface for wind action. The provision of bouyancy on all three sides ensures that even if it rolls over, the craft will float. The occupant, by moving his weight can easily right it. The tubular structures, being full of air, will provide effective thermal insulation all around the occupant.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A single person survival craft comprising a bottom panel, and two side panels, the bottom panel, in turn, comprising a plurality of hollow tubular structures, said bottom panel having two pointed ends, and a wide mid-section, there being two full length peripheral hollow tubular structures, and a predetermined number of intermediate reduced length hollow tubular structures in the region of said bottom panel mid-section, said number of tubular structures progressively decreasing towards each of said pointed ends, said tubular structures in said bottom panel being of curved shape said two full length peripheral hollow tubular structure, and at least some of said intermediate hollow tubular structures being curved around a radius which decreases progressively from said mid-section to each of said ends, adjacent said hollow tubular structures being joined to one another in side by side abutting relationship: and each of said side panels having pointed ends and a wide mid-section, and there being a predetermined number of hollow tubular structures at said mid-section and said numbers of said tubular structures decreasing progressively from said mid-section towards each of said pointed ends, each said side panel being joined to said bottom panel along a first edge at the adjacent respective ones of said full length peripheral hollow tubular structures of said bottom panel, and, there being releasable closure means extending along portions of a second edge of each said side panel, whereby said second edges may be at least partially opened up and closed together, and air permeable mesh means in at least one of said side panels.

2. A single person survival craft as claimed in claim 1 wherein in each of said side panels there is a said tubular structure extending from one said pointed end to the other, and there being further said tubular structures of progressively reduced length nesting there within.

3. A single person survival craft as claimed in claim 1 including closure operating means for said releaseable closure means, located both on the inside and the outside of said craft.

4. A single person survival craft as claimed in claim 1 including junction passageways between said tubular structures in said bottom panel and in said side panels, and inflation means for inflating said tubular structures.

5. A single person survival craft as claimed in claim 1 including bailing pump means communicating to the exterior of said craft, for bailing water therefrom.

6. A single person survival craft as claimed in claim 1, wherein each of said side panels comprises a full length tubular structure, extending from one end to the other of said survival craft, and a plurality of adjacent tubular structures of lesser length than said full length structure, and wherein at least said full length tubular structures define a radius which decreases progressively from the mid-section of said craft to either end.

* * * * *